United States Patent [19]

Wahlers et al.

[11] 4,215,020

[45] Jul. 29, 1980

[54] ELECTRICAL RESISTOR MATERIAL, RESISTOR MADE THEREFROM AND METHOD OF MAKING THE SAME

[75] Inventors: Richard L. Wahlers, Churchville; Kenneth M. Merz, Gladwyne, both of Pa.

[73] Assignee: TRW Inc., Cleveland, Ohio

[21] Appl. No.: 892,693

[22] Filed: Apr. 3, 1978

[51] Int. Cl.[2] ..... H01B 1/06

[52] U.S. Cl. ..... 252/519; 252/518; 252/521; 106/54; 427/101; 428/427; 428/432; 338/21

[58] Field of Search ..... 252/518, 519, 521; 427/101; 428/427, 432; 338/21; 106/54

[56] References Cited

U.S. PATENT DOCUMENTS

| | | | |
|---|---|---|---|
| 3,044,901 | 7/1962 | Garnsworthy | 252/518 X |
| 3,669,907 | 6/1972 | Kohashi et al. | 252/518 |
| 3,888,796 | 6/1975 | Nigol | 252/518 |
| 3,915,721 | 10/1975 | Kamigaito et al. | 252/518 |
| 4,051,074 | 9/1977 | Asada | 252/518 X |
| 4,065,743 | 12/1977 | Wahlers et al. | 252/521 |

*Primary Examiner*—Benjamin R. Padgett
*Assistant Examiner*—J. Lloyd Barr
*Attorney, Agent, or Firm*—Jacob Trachtman

[57] ABSTRACT

A vitreous enamel resistor material comprising a mixture of a glass frit, and fine particles of tin oxide ($SnO_2$), a primary additive of particles of oxides of manganese, nickel, cobalt or zinc, and a supplemental additive of oxides of tantalum, niobium, tungsten or nickel. An electrical resistor is made from the resistor material by applying the material to a substrate and firing the coated substrate to a temperature at which the glass melts. The tin oxide may be heat treated prior to mixing the glass frit. Upon cooling, the substrate has on the surface thereof, a film of the glass having the particles of the mixture embedded therein and dispersed therethroughout. The resistor material provides a resistor having a wide range of resistivities and a low temperature coefficient of resistance.

42 Claims, 1 Drawing Figure

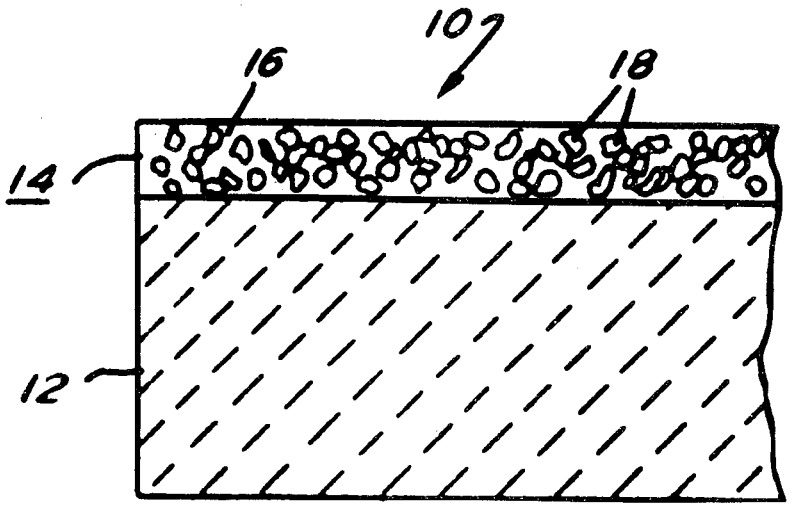
10
16
18
14
12

ELECTRICAL RESISTOR MATERIAL, RESISTOR MADE THEREFROM AND METHOD OF MAKING THE SAME

The present invention relates to a resistor material, resistors made from the material, and a method of making the material. More particularly, the present invention relates to a vitreous enamel resistor material which provides resistors over a wide range of resistivities and with relatively low temperature coefficients of resistance, and which are made from relatively inexpensive materials.

A type of electrical resistor material which has recently come into commercial use is a vitreous enamel resistor material which comprises a mixture of a glass frit and finely divided particles of an electrical conductive material. The vitreous enamel resistor material is coated on the surface of a substrate of an electrical insulating material, usually a ceramic, and fired to melt the glass frit. When cooled, there is provided a film of glass having the conductive particles dispersed therein.

Since there are requirements for electrical resistors having a wide range of resistance values, it is desirable to have vitreous enamel resistor materials with respective properties which will allow the making of resistors over a wide range of resistance values. However, a problem has arisen with regard to providing a vitreous enamel resistor material which will provide resistors having a wide range of resistivity values and which are also relatively stable with changes in temperature, i.e., has a low temperature coefficient of resistance. The resistor materials which provide both a wide range of resistivities and low temperature coefficients of resistance generally utilize the noble metals as the conductive particles and are therefore relatively expensive. As described in the article by J. Dearden entitled "High Value, High Voltage Resistors," ELECTRONIC COMPONENTS, March 1967, pages 259–261, a vitreous enamel resistor material using tin oxide doped with antimony has been found to provide high resistivities and is of a less expensive material. However, this material also has a high negative temperature coefficient of resistance.

It is therefore an object of the present invention to provide a novel resistor material and resistor made therefrom.

It is another object of the present invention to provide a novel vitreous enamel resistor material and a resistor made therefrom.

It is still a further object of the present invention to provide a vitreous enamel resistor material which provides a resistor having a wide range of resistivities and a relatively low temperature coefficient of resistance.

It is another object of the present invention to provide a vitreous enamel resistor material including tin oxide particles which provides a resistor having a lower resistivity than is attainable with a tin oxide glaze resistor, a relatively low temperature coefficient of resistance, and the high stability of such glaze resistors but without using expensive material.

It is yet another object of the present invention to provide a vitreous enamel resistor material which provides resistors having a high compatibility with inexpensive nickel terminations.

Other objects will appear hereinafter.

These objects are achieved by a resistor material comprising a mixture of a glass frit and finely divided particles of tin oxide, a primary additive of $MnO_2$, NiO, $Co_3O_4$, or ZnO, and a supplemental additive of $Ta_2O_5$, NiO, $Nb_2O_5$ or $WO_3$. The tin oxide may be heat treated prior to mixing with the glass frit.

The invention accordingly comprises a composition of matter possessing the characteristics, properties, and the relation of components which are exemplified in the compositions hereinafter described, and the scope of the invention is indicated in the claims.

For a fuller understanding of the nature and objects of the invention, reference should be had to the following detailed description taken in connection with the accompanying drawing in which:

The FIGURE of the drawing is a sectional view of a portion of a resistor made with the resistor material of the present invention.

In general the vitreous enamel resistor material of the present invention comprises a mixture of a vitreous glass frit and fine particles of tin oxide ($SnO_2$). The glass frit is present in the resistor material in the amount of 10% to 80% by volume, and preferably in the amount of 35% to 60% by volume. A primary additive of $MnO_2$, NiO, $Co_3O_4$ or ZnO of between 0.07 to 18.5% by volume, and preferably between 1 to 10% by volume is included in the mixture, while a supplemental additive, when used, provides by volume of the mixture up to about 1% tantalum oxide, 0.4% niobium oxide, 7% tungsten trioxide, or 5% nickel oxide.

The glass frit used must have a softening point below the melting point of the oxide particles of the conductive phase. It has been found that the use of a borosilicate frit is preferable, and particularly an alkaline earth borosilicate frit, such as a barium or calcium borosilicate frit. The preparation of such frits is well known and consists, for example, of melting together the constituents of the glass in the form of the oxides of the constituents, and pouring such molten composition into water to form the frit. The batch ingredients may, of course, be any compound that will yield the desired oxides under the usual conditions of frit production. For example, boric oxide will be obtained from boric acid, silicon dioxide will be produced from flint, barium oxide will be produced from barium carbonate, etc. The coarse frit is preferably milled in a ball mill with water to reduce the particle size of the frit and to obtain a frit of substantially uniform size.

The resistor material of the present invention may be made by thoroughly mixing together the glass frit, and the tin oxide and additive particles in the appropriate amounts. The mixing is preferably carried out by ball milling the ingredients in water or an organic medium, such as butyl carbitol acetate or a mixture of butyl carbitol acetate and toluol. The mixture is then adjusted to the proper viscosity for the desired manner of applying the resistor material to a substrate by either adding or removing the liquid medium of the mixture. For screen stencil application, the liquid may be evaporated and the mixture blended with a screening vehicle such as manufactured by L. Reusche and Company, Newark, N.J.

Another method of making the resistor material which provides a wider resistance range and better control of temperature coefficient of resistivity, is to first heat treat the tin oxide. The heat treated tin oxide is then mixed with the additives and glass frit to form the resistor material. The tin oxide powder was heat treated as follows: A boat containing the tin oxide is placed on the belt of a continuous furnace. The boat is fired at a peak temperature of 575° C. over a one-half hour cycle in a forming gas atmosphere (95% $N_2$ and 5% $H_2$).

To make a resistor with the resistor material of the present invention, the resistor material is applied to a uniform thickness on the surface of a substrate. The substrate may be a body of any material which can withstand the firing temperature of the resistor material. The substrate is generally a body of a ceramic or glass, such as porcelain, steatite, barium titanate, alumina, or the like. The resistor material may be applied on the substrate by brushing, dipping, spraying, or screen stencil application. The resistor material is then dried, such as by heating at a low temperature, e.g., 150° C. for 15 minutes. The vehicle mixed with the tin oxide may be burned off by heating at a slightly higher temperature prior to the firing of the resistor.

The substrate with the resistor material coating is then fired in a conventional furnace at a temperature at which the glass frit becomes molten. The resistor material is fired in an inert atmosphere, such as argon, helium or nitrogen. The resistance and temperature coefficient of resistance varies with the firing temperature used. The firing temperature can be selected to provide a desired resistance value with an optimum temperature coefficient of resistance. The minimum firing temperature, however, is determined by the melting characteristics of the glass frit used. When the substrate and the resistor material are cooled, the vitreous enamel hardens to bond the resistance material to the substrate.

As shown in the FIGURE of the drawing, a resultant resistor of the present invention is generally designated as 10. Resistor 10 comprises a ceramic substrate 12 having a layer 14 of the resistor material of the present invention coated and fired thereon. The resistor material layer 14 comprises the glass 16 containing the finely divided tin oxide and additive oxide particles 18. The tin oxide and additive oxide particles 18 are embedded in and dispersed throughout the glass 16.

The following examples are given to illustrate certain preferred details of the invention, it being understood that the details of the examples are not to be taken as in any way limiting the invention thereto.

EXAMPLE I

A resistance material was made by mixing together 55% by volume of tin oxide particles ($SnO_2$) which were heat treated as described above and additive particles, and 45% by volume of particles of a glass of the composition, by weight, of 50% barium oxide (BaO), 20% boron oxide ($B_2O_3$) and 30% silicon dioxide ($SiO_2$). The tin oxide, additives and glass mixture was ball milled in butyl carbitol acetate for one day. The butyl carbitol acetate was then evaporated and the dry mixture was then blended with a Ruesche screening vehicle on a three roll mill.

The resistance material was made into resistors by screening the material onto alumina substrates containing thick film nickel termination pads. The resistance material layers were dried for 15 minutes at 150° C. Various ones of the resistors were then fired at a temperature of 1000° C. over a one-half hour cycle in a nitrogen atmosphere in a continuous belt furnace. The resistors formed on the substrates each had a length of one and a half times their width, each providing 1.5 square resistor patterns.

Table I shows the resistance values and temperature coefficients of resistance of the various resistors made in accordance with Example I for the volume % of the additives shown.

TABLE I

| Additive | Volume % | Resistance K ohms/square | Temperature Coefficient of Resistance (ppm/°C.) −81° C. | 150° C. |
|---|---|---|---|---|
| None | 0 | 54.0 | 42 | 136 |
| $MnO_2$ | 0.10 | 48.6 | 198 | 186 |
| | 1.1 | 25.8 | 43 | 206 |
| | 8.4 | 24.6 | −1334 | −589 |
| NiO | 0.07 | 45.1 | 246 | 201 |
| | 0.73 | 13.7 | ±44 | 315 |
| | 5.0 | 13.7 | −493 | −328 |
| $Co_3O_4$ | 0.08 | 44.2 | 207 | 193 |
| | 5.3 | 10.3 | 182 | 505 |
| | 10.5 | 50.8 | −130 | −108 |
| ZnO | 0.33 | 44.4 | 56 | 122 |
| | 9.4 | 4.97 | 187 | 704 |
| | 18.5 | 31.2 | −2576 | −2704 |

EXAMPLE II

A resistance material was made in the same manner as in Example I, except that the tin oxide particles were not heat treated, the additive being 9.44% by volume of zinc oxide (ZnO). The resistance material was made into resistors in the same manner as described in Example I. Table II shows the resistance values and temperature coefficients of resistance of the resistors made without and with heat treated tin oxide particles ($SnO_2$).

TABLE II

| Heat Treatment of $SnO_2$ | Volume % ZnO Additive | Resistance K ohms per square | Temperature Coefficient of Resistance (ppm/°C.) −81° C. | +150° C. |
|---|---|---|---|---|
| 575° C. ½ Hr in 95% $N_2$/5% $H_2$ | 9.44 | 4.97 | 187 | 704 |
| None | 9.44 | 5.70 | 103 | 638 |

EXAMPLE III

A resistance material was made in the same manner as in Example I, except that composition "A" of the glass particles contained, by weight, 48% barium oxide (BaO), 8% calcium oxide (CaO), 23% boron oxide ($B_2O_3$), and 21% silicon dioxide ($SiO_2$), and composition "B" contained, by weight, 42% barium oxide (BaO), 23% boron oxide ($B_2O_3$), and 29% silicon dioxide ($SiO_2$). The resistance materials were made into resistors in the same manner as described in Example I. Table III shows the resistance values and temperature coefficients of resistance of the resistors.

TABLE III

| Glass Composition | Volume % Additive | Resistance K ohms per square | Temperature Coefficient of Resistance (ppm/°C.) −81° C. | +150° C. |
|---|---|---|---|---|
| A | 9.44 ZnO | 5.83 | −214 | 323 |
| B | 0.89 $Co_3O_4$ | 7.87 | −440 | ±38 |

EXAMPLE IV

A resistance material was made in the same manner as in Example I, and the resistance material was made into resistors in the same manner as described in Example I. Table IV shows the resistance values and temperature coefficients of resistance of the resistors which were fired at different temperatures.

TABLE IV

| Additive | Volume % | Peak Firing Temp. ° C. | Resistance K ohms per square | Temperature of Coefficient Resistanct (ppm/°C.) −81 | +150 |
|---|---|---|---|---|---|
| $MnO_2$ | 1.1 | 950° C. | 79.0 | −36 | 40 |
| | | 1050° C. | 11.8 | 175 | 226 |
| NiO | 0.73 | 950° C. | 37.5 | ±21 | 91 |
| | | 1050° C. | 5.2 | 196 | 443 |
| $Co_3O_4$ | 5.3 | 950° C. | 18.2 | 166 | 337 |
| | | 1000° C.* | 6.8 | 68 | 541 |
| | | 1050° C. | 5.0 | 224 | 541 |
| ZnO | 9.4 | 950° C. | 6.5 | 432 | 714 |
| | | 1000° C.* | 18.9 | 448 | 124 |

*Fired for 1 hour

EXAMPLE V

Resistance materials were made in the same manner as Example I, using various primary and supplemental additives, and the materials were used to make resistors in the same manner as described in Example I. Table V shows the resistance values and temperature coefficients of resistance of the resistors for the various compositions.

TABLE V

| Primary Additive | Volume % | Supple. Additive | Volume % | Resistance K ohms per square | Temp. Coeff. of Resistance (ppm/°C.) −81 | +150 |
|---|---|---|---|---|---|---|
| $MnO_2$ | 1.1 | None | — | 25.8 | 43 | 206 |
| | 1.07 | $Ta_2O_5$ | 0.33 | 40.7 | −142 | −97 |
| | 1.4 | NiO | 1.9 | 9.99 | −120 | 16 |
| NiO | 0.73 | None | — | 13.7 | ±44 | 315 |
| | 0.73 | $Ta_2O_5$ | 0.33 | 9.09 | −147 | −139 |
| $Co_3O_4$ | 5.32 | None | — | 10.3 | 182 | 505 |
| | 5.32 | $Ta_2O_5$ | 0.23 | 6.88 | −65 | −63 |
| | 1.78 | NiO | 1.91 | 7.93 | 268 | 43 |
| ZnO | 9.4 | None | — | 4.97 | 187 | 704 |
| | 9.45 | $Ta_2O_5$ | 0.16 | 1.86 | 54 | 57 |
| | 9.44 | $Nb_2O_5$ | 0.07 | 2.23 | −131 | 42 |
| | 9.45 | $WO_3$ | 3.7 | 2.86 | 96 | 164 |
| $MnO_2$/ $Co_3O_4$ | 1.07/ 1.33 | NiO | 1.43 | 6.57 | 143 | 40 |

EXAMPLE VI

Resistance materials were made in the same manner as in Example I with the glass content varying from 10 to 80 volume percent, and tin oxide and additive particles, as shown in Table VI. The resistance materials were made into resistors in the same manner as described in Example I. Table VI shows the resistance values of the resistors.

TABLE VI

| Glass Volume % | Tin Oxide $SnO_2$ Volume % | Additive | Additive Volume % | Resistance K ohms per square |
|---|---|---|---|---|
| 80.0 | 20.0 | None | — | 356 |
| | 19.55 | NiO | 0.45 | 7066 |
| | 19.25 | $MnO_2$ | 0.75 | 3917 |
| | 18.0 | $Co_3O_4$ | 2.00 | 255 |
| | 17.0 | ZnO | 3.00 | 2255 |
| 60.0 | 40.0 | None | — | 470 |
| | 39.25 | $MnO_2$ | 0.75 | 479 |
| | 38.0 | $Co_3O_4$ | 2.00 | 120.4 |
| | 37.0 | ZnO | 3.00 | 122.4 |
| 59.23 | 40.32 | NiO | 0.45 | 369 |

TABLE VI-continued

| Glass Volume % | Tin Oxide $SnO_2$ Volume % | Additive | Additive Volume % | Resistance K ohms per square |
|---|---|---|---|---|
| 45.0 | 55.0 | None | — | 54.9 |
| | 54.27 | NiO | 0.73 | 13.7 |
| | 53.9 | $MnO_2$ | 1.10 | 28.5 |
| | 49.68 | $Co_3O_4$ | 5.32 | 10.3 |
| | 45.6 | ZnO | 9.40 | 4.97 |
| 35.0 | 65.0 | None | — | 11.8 |
| | 64.55 | NiO | 0.45 | 5.70 |
| | 64.25 | $MnO_2$ | 0.75 | 8.26 |
| | 63.0 | $Co_3O_4$ | 2.00 | 2.88 |
| | 62.0 | ZnO | 3.00 | 2.39 |
| 30.0 | 70.0 | None | — | 9.31 |
| | 69.55 | NiO | 0.45 | 5.67 |
| | 69.25 | $MnO_2$ | 0.75 | 5.92 |
| | 68.0 | $Co_3O_4$ | 2.00 | 2.42 |
| | 67.0 | ZnO | 3.00 | 2.07 |
| 20.0 | 80.0 | None | — | 10.3 |
| | 79.55 | NiO | 0.45 | 5.07 |
| | 79.25 | $MnO_2$ | 0.75 | 2.54 |
| | 78.0 | $Co_3O_4$ | 2.00 | 1.41 |
| | 77.0 | ZnO | 3.00 | 2.69 |
| 15 | 85.0 | None | — | 10.6 |
| | 84.55 | NiO | 0.45 | 5.71 |
| | 84.25 | $MnO_2$ | 0.75 | 2.97 |
| | 83.00 | $Co_3O_4$ | 2.00 | 1.49 |
| | 82.00 | ZnO | 3.00 | 10.5 |
| 10 | 90.0 | None | — | 19.9 |
| | 89.55 | NiO | 0.45 | 11.2 |
| | 89.25 | $MnO_2$ | 0.75 | 7.7 |
| | 88.00 | $Co_3O_4$ | 2.00 | 1.63 |
| | 87.00 | ZnO | 3.00 | 27.7 |

From the above examples there can be seen the effects, on the electrical characteristics of the resistor of the present invention, of variations in the composition of the resistance material and the method of making the resistance material. Examples I, III, V and VI show the effects of varying the composition and ratio of the oxide particles. Example II shows the effect of heat treating the tin oxide particles, while Example III shows the effects of varying the composition of the glass frit. Example IV shows the effect of varying the firing temperature of the resistors, and Example VI shows the effect of varying the composition, and proportion of the glass particles to the tin oxide and additive particles. Thus, there is provided by the present invention a vitreous enamel resistor using tin oxide and additives which is relatively stable with regard to temperature and is made of materials which are relatively inexpensive.

The resistors of the invention were terminated with thick film nickel glaze terminations to obtain the test results. Resistor glazes based on noble metals are typically terminated with expensive precious metal materials such as platinum, palladium, and gold. This resistor, however, is compatible with terminations made on non-noble metals such as copper and nickel. This has the advantage of both reducing the cost of the resistor, and providing a more solderable termination.

It will thus be seen that the objects set forth above, among those made apparent from the preceding description, are efficiently attained and, since certain changes may be made in the above composition of matter without departing from the scope of the invention, it is intended that all matter contained in the above description shall be interpreted as illustrative and not in a limiting sense.

What is claimed is:

1. A vitreous enamel resistor material comprising a mixture of glass frit, and finely divided particles of tin oxide and of an additive, said additive being selected from the group consisting of the oxides of manganese, nickel, cobalt and zinc, the particles of tin oxide and the additive being present in an amount of 20 to 90% by volume, and the additive being present in an amount of about 0.07 to 18.5% by volume.

2. A vitreous enamel resistor material in accordance with claim 1 in which the glass frit is present in an amount of 35 to 60% by volume.

3. A vitreous enamel resistor material in accordance with claim 1 in which the additive is present in the amount of 1 to 10% by volume.

4. A vitreous enamel resistor material in accordance with claim 1 in which the material includes as a supplemental additive up to 1% by volume of tantalum oxide.

5. A vitreous enamel resistor material in accordance with claim 1 in which the material includes as a supplemental additive up to 0.4% by volume of niobium oxide.

6. A vitreous enamel resistor material in accordance with claim 1 in which the material includes as a supplemental additive up to 7% by volume of tungsten trioxide.

7. A vitreous enamel resistor material in accordance with claim 1 in which in the absence of nickel oxide as an additive the material includes as a supplemental additive up to 5% by volume of nickel oxide.

8. A vitreous enamel resistor material in accordance with claim 1 in which the glass frit is a borosilicate glass.

9. A vitreous enamel resistor material in accordance with claim 2 in which the glass frit is an alkaline earth borosilicate frit.

10. An electrical resistor comprising an insulating substrate and a film of glass on a surface of the substrate, and a conductive phase consisting essentially of fine particles of tin oxide and of an additive selected from the group consisting of the oxides of manganese, nickel, cobalt and zinc embedded within and dispersed throughout the glass film, the particles of tin oxide and the additive being present in the glass film in an amount of 20 to 90% by volume, and the additive being present in an amount of about 0.07 to 18.5% by volume.

11. An electrical resistor in accordance with claim 10 in which the particles of tin oxide and the additive are present in the glass film in the amount of.40 to 65% by volume.

12. An electrical resistor in accordance with claim 10 in which the additive particles are present in the glass film in the amount of 1 to 10% by volume.

13. An electrical resistor in accordance with claim 10 in which the additive particles include a supplemental additive of up to 1% by volume of tantalum oxide.

14. An electrical resistor in accordance with claim 10 in which the additive particles include a supplemental additive of up to 0.4% by volume of niobium oxide.

15. An electrical resistor in accordance with claim 10 in which the additive particles include a supplemental additive of up to 7% by volume of tungsten trioxide.

16. An electrical resistor in accordance with claim 10 in which in the absence of nickel oxide as an additive the additive particles include a supplemental additive of up to 5% by volume of nickel oxide.

17. An electrical resistor in accordance with claim 10 in which the glass of said film is a borosilicate glass.

18. An electrical resistor in accordance with claim 11 in which the glass of said film is an earth borosilicate glass.

19. A method of making an electrical resistor comprising the steps of mixing together a glass frit, and a conductive phase consisting essentially of fine particles of tin oxide and of an additive selected from the group consisting of the oxides of manganese, nickel, cobalt and zinc, the particles of tin oxide and the additive being present in the amount of 20% to 90% by volume, and the additive being present in an amount of about 0.07 to 18.5% by volume, applying said mixture to a surface of a substrate, and firing said coated substrate in a substantially inert atmosphere to the melting temperature of the glass frit, and cooling the coated substrate to form a resistive film.

20. The method in accordance with claim 19 in which the glass frit, and tin oxide and additive particles are mixed with a vehicle suitable for applying the mixture to the substrate, and after the mixture is applied to the substrate it is dried.

21. The method in accordance with claim 20 in which prior to firing the coated substrate it is heated to burn off the vehicle in the mixture.

22. The method in accordance with claim 19 in which prior to mixing the tin oxide with glass frit, the tin oxide is heat treated.

23. The method in accordance with claim 22 in which the tin oxide is heat treated in an atmosphere of forming gas at a peak temperature of about 575° C. over a one-half hour cycle.

24. An electrical resistor of the vitreous glaze type made by mixing together a glass frit, and a conductive phase consisting essentially of fine particles of tin oxide and of an additive selected from the group consisting of the oxides of manganese, nickel, cobalt and zinc, the particles of tin oxide and the additive being present in the amount of 20 to 90% by volume, and the additive being present in an amount of about 0.07 to 18.5% by volume, applying said mixture to a surface of a substrate, and firing said coated substrate in a substantially inert atmosphere to the melting temperature of the glass frit, and cooling the coated substrate to form a resistive film.

25. An electrical resistor made in accordance with claim 24 in which the glass frit, and tin oxide and additive particles are mixed with a vehicle suitable for applying the mixture to the substrate, and after the mixture is applied to the substrate it is dried.

26. An electrical resistor made in accordance with claim 25 in which prior to firing the coated substrate it is heated to burn off the vehicle in the mixture.

27. An electrical resistor made in accordance with claim 24 in which prior to mixing the tin oxide with glass frit, the tin oxide is heat treated.

28. An electrical resistor made in accordance with claim 27 in which the tin oxide is heat treated in an atmosphere of forming gas at a peak temperature of about 575° C. over a one-half hour cycle.

29. The method in accordance with claim 19 in which the glass frit is present in an amount of 35 to 60% by volume.

30. The method in accordance with claim 19 in which the additive is present in the amount of 1 to 10% by volume.

31. The method in accordance with claim 19 in which the material includes as a supplemental additive up to 1% by volume of tantalum oxide.

32. The method in accordance with claim 19 in which the material includes as a supplemental additive up to 0.4% by volume of niobium oxide.

33. The method in accordance with claim 19 in which the material includes as a supplemental additive up to 7% by volume of tungsten trioxide.

34. The method in accordance with claim 19 in which in the absence of nickel oxide as an additive, the material includes as a supplemental additive up to 5% by volume of nickel oxide.

35. The method in accordance with claim 29 in which the glass frit is a borosilicate glass.

36. An electrical resistor made in accordance with claim 24 in which the glass frit is present in an amount of 35 to 60% by volume.

37. An electrical resistor made in accordance with claim 24 in which the additive is present in the amount of 1 to 10% by volume.

38. An electrical resistor made in accordance with claim 24 in which the material includes as a supplemental additive up to 1% by volume of tantalum oxide.

39. An electrical resistor made in accordance with claim 24 in which the material includes as a supplemental additive up to 0.4% by volume of niobium oxide.

40. An electrical resistor made in accordance with claim 24 in which the material includes as a supplemental additive up to 7% by volume of tungsten trioxide.

41. An electrical resistor made in accordance with claim 24 in which in the absence of nickel oxide as an additive, the material includes as a supplemental additive up to 5% by volume of nickel oxide.

42. An electrical resistor made in accordance with claim 36 in which the glass frit is a borosilicate glass.

* * * * *

UNITED STATES PATENT AND TRADEMARK OFFICE

CERTIFICATE OF CORRECTION

PATENT NO. : 4,215,020

DATED : July 29, 1980

INVENTOR(S) : Richard L. Wahlers and Kenneth M. Merz

It is certified that error appears in the above-identified patent and that said Letters Patent are hereby corrected as shown below:

Claim 11, line 43, ".40" should read -- 40 --

Signed and Sealed this

*Twenty-fifth* Day of *November 1980*

[SEAL]

*Attest:*

SIDNEY A. DIAMOND

*Attesting Officer*

*Commissioner of Patents and Trademarks*